US010826223B2

(12) United States Patent
Drost

(10) Patent No.: US 10,826,223 B2
(45) Date of Patent: Nov. 3, 2020

(54) CHARGING CABLE EXTRACTION DEVICE

(71) Applicant: Paul Drost, Gilbertsville, PA (US)

(72) Inventor: Paul Drost, Gilbertsville, PA (US)

( * ) Notice: Subject to any disclaimer, the term of this patent is extended or adjusted under 35 U.S.C. 154(b) by 0 days.

(21) Appl. No.: 16/139,150

(22) Filed: Sep. 24, 2018

(65) Prior Publication Data

US 2019/0097348 A1 Mar. 28, 2019

Related U.S. Application Data

(60) Provisional application No. 62/562,677, filed on Sep. 25, 2017.

(51) Int. Cl.

| | |
|---|---|
| ***H01R 13/516*** | (2006.01) |
| ***H01R 13/53*** | (2006.01) |
| ***H01R 13/422*** | (2006.01) |
| ***H01R 13/633*** | (2006.01) |
| *H01R 13/56* | (2006.01) |

(52) U.S. Cl.

CPC ..... *H01R 13/516* (2013.01); *H01R 13/422* (2013.01); *H01R 13/53* (2013.01); *H01R 13/6335* (2013.01); *H01R 13/562* (2013.01)

(58) Field of Classification Search

CPC ..... H01R 13/516; H01R 13/422; H01R 13/53

See application file for complete search history.

(56) References Cited

U.S. PATENT DOCUMENTS 5,813,877 A * 9/1998 Nakamura ..... H01R 12/79 439/267

2015/0319274 A1 11/2015 McLoughlin

2016/0241067 A1 8/2016 Miracle

* cited by examiner

*Primary Examiner* — Abdullah A Riyami

*Assistant Examiner* — Nader J Alhawamdeh

(74) *Attorney, Agent, or Firm* — Wendy W. Koba

(57) ABSTRACT

A connection support cover is proposed that fits over the connecting end of the cable. The connection support cover is generally U-shaped and includes an aperture at the bottom of the U to allow for the actual connector portion of the cable to protrude through the cover. The connector support cover provides a larger, easier to grip surface and allows an individual to quickly and easily remove a cable from a device without harming either the cable or the embedded connector within the device.

9 Claims, 2 Drawing Sheets

CHARGING CABLE EXTRACTION DEVICE

CROSS-REFERENCE TO RELATED APPLICATIONS

This application claims the benefit of U.S. Provisional Application No. 62/562,677, filed Sep. 25, 2017 and herein incorporated by reference.

TECHNICAL FIELD

The present invention relates to chargeable electronic devices and, more particularly, to an instrumentation for providing repeatable insertion and removal of a charging cable with respect to the electronic device.

BACKGROUND OF THE INVENTION

The ubiquitous nature of electronic devices has led to the inevitable result that every device has its own power cable, used to re-charge the device (or at times simply used to provide power to a device as it is being used). From cellphones to tablets, electronic readers to gaming systems, each device may have a different type of power cable. Various ones currently include, but are not limited to: USB A-type, USB B-type, USB C-type, micro-USB A, micro-USB B, USB mini-b, etc.

While necessary, these cords have been found to lack in ruggedness, and repeated use (in terms of plugging into or removing from an embedded connector on a periphery of a device) has inevitably led to fraying of the cord, breaking of the cord (particularly at the connector), bent embedded connectors within the device, and the like. Indeed, while most of these power cables have a defined direction in which they may be inserted, their small size results in individuals forcing a cable connector "upside-down" into the device's embedded connector port, harming both the cable and the device.

Indeed, the mere act of pulling on the cable's "body" to remove it from a device after charging has been found to damage both the cable and the connector.

SUMMARY OF THE INVENTION

The needs remaining in the prior art are addressed by the present invention, which relates to chargeable electronic devices and, more particularly, to an instrumentation for providing repeatable insertion and removal of a charging cable from the device.

In accordance with the principles of the invention, as described fully below, the inventive instrumentation takes the form of a connection support cover that fits over the connecting end of the cable. The connection support cover provides a larger, easier to grip surface to allow an individual to quickly and easily remove a cable from a device without harming either the cable or the embedded connector within the device.

An exemplary embodiment of the present invention is defined as s connector support cover for protecting and controlling a connection between a charging port of an electronic device and an associated charging cable. The connector support cover comprises an upper grip arm of a predetermined length (the upper grip arm having first and second opposing end terminations), a lower grip arm of the predetermined length (the lower grip arm also having first and second opposing end terminations), and an end portion disposed between and joined to the first end terminations of the upper grip arm and the lower grip arm so as to form a U-shaped device. The end portion is formed to include a central aperture of dimensions sufficient to allow a charging cable connector to pass through while blocking a body region of the charging cable by the remainder of the end portion.

Other and further embodiments and features of the present invention will become apparent during the course of the following discussion and by reference to the associated drawings.

BRIEF DESCRIPTION OF THE DRAWINGS

Referring now to the drawings, where like reference numerals reference like parts in several views.

DETAILED DESCRIPTION

Figure 1:
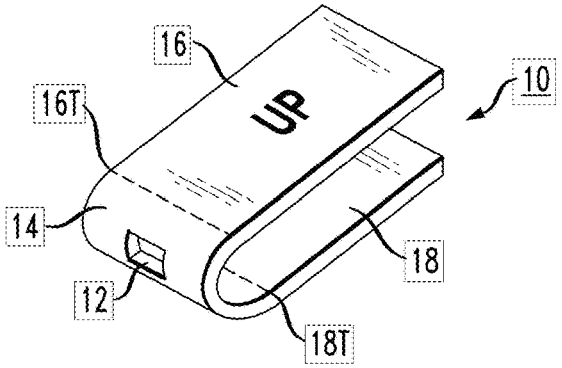
FIG. 1 illustrates an exemplary connector support cover, formed in accordance with the present invention.

FIG. 1 is an isometric view of an exemplary connector support cover 10 formed in accordance with the present invention. Connector support cover 10 is shown as a generally U-shaped element, with an aperture 12 formed within an end portion 14. As also shown in FIG. 1, connector support cover 10 includes an upper grip arm 16 and a lower grip arm 18, attached to end portion 14 to form the general "U" shape. That is, upper grip arm 16 and lower grip arm 18 take the form of a pair of parallel sides, with end terminations 16T and 18T of arms 16 and 18, respectively, joining opposing end terminations $T_1$ and $T_2$ of end portion 14. In an exemplary embodiment, upper grip arm 16 and lower grip arm 18 are formed of a flexible material (e.g., low density plastic, laminated paper, or the like). It is to be understood that in a preferred embodiment of the present invention, the combination of end portion 14 and grip arms 16, 18 is configured as a unitary element and formed of a single piece of material (as discussed below in association with FIG. 4).

Figure 2:
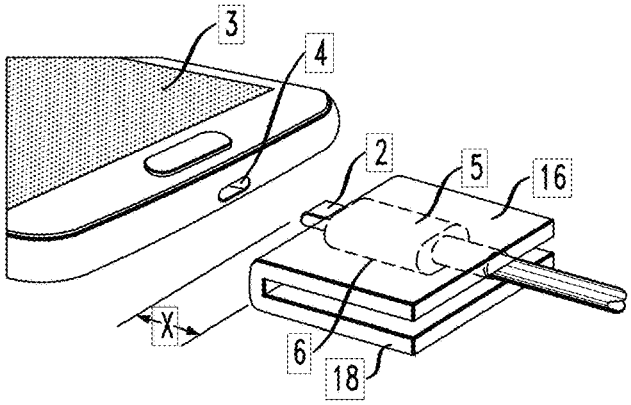
FIG. 2 illustrates the connector support cover of FIG. 1, as disposed over a connecting end of an electronic device charging cable.

FIG. 2 is an isometric view of connector support cover 10 of FIG. 1 as disposed in place over a connecting end of an electronic device charging cable 1. Connector support cover 10 is shown as positioned over charging cable 1 such that a connector 2 passes through aperture 12 of cover 10 so as to be exposed in the manner necessary for inserting connector 2 into a charging port 4 of electronic device 3.

As shown in FIG. 2, when connector support cover 10 is positioned over charging cable 1, upper grip arm 16 of cover 10 flexes (under applied pressure from an individual's grip) to cover a top surface 5 of charging cable 1. Lower grip arm 18 of connector support cover 10 flexes to contact a bottom surface 6 of charging cable 1 in a similar manner. In accordance with the present invention, upper grip arm 16 and lower grip arm 18 are formed of a size that allows for an individual to easily grasp both grip arms and either connect or disconnect charging cable 1 from its associated device 3. By virtue of including connector support cover 10, the force applied by an individual to remove a cable from a device is spread over a larger area (namely, the upper and lower grip surfaces of the cover) and the chance of cable damage is reduced.

Figure 3:
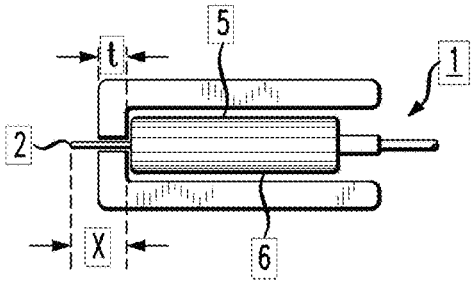
FIG. 3 is a cut-away side view of the configuration of FIG. 2.

In accordance with the present invention and shown in a cut-away side view of FIG. 3, end portion 14 of connector support cover 10 is formed to have a thickness t that does not interfere with the physical/electrical connection between the cable and the device being charged. As clearly shown in FIG. 3, a majority of connector 2 extends beyond end portion 14 of connector support cover 10. Said another way, for a connector 2 of a predetermined length X, end portion 14 is required to have a thickness t substantially less than X (where in most cases t can be no greater than 0.5 X). Thus, by controlling the thickness t of the inventive support cover, the integrity of the connection between cable 1 and device 3 can be maintained.

As mentioned above, connector support cover 10 may be formed of any suitable, non-conductive material. Exemplary choices include many different plastics (hard or soft), heavy-weight paper, silicone, and the like. In some cases, end portion 14 may be formed of a different material than the upper and lower support arms. An important feature of end portion 14 is its relative thickness with respect to an associated connector, and so an extremely thin, stiff material may satisfy this requirement. An important feature of upper and lower support arms 16, 18 is their flexibility (as well as their ability to be easily gripped by an individual). Thus, in some embodiments the specific components may be formed of different materials that are thereafter bonded together.

Alternatively, various embodiments of the present invention may comprise a unitary structure, formed of a single piece of material that exhibits all of the desired properties in terms of thickness and flexibility. Silicone or a heavy-weight paper are two choices that may be appropriate for a unitary construction embodiment.

Figure 4:
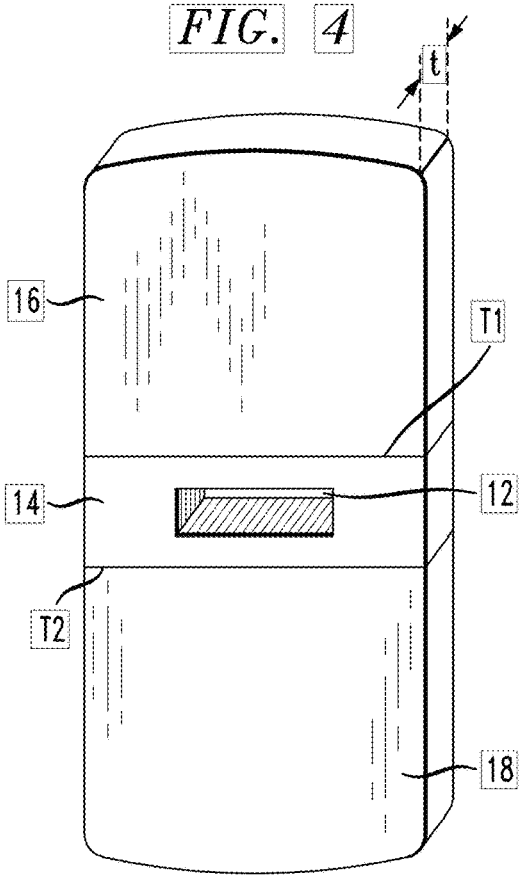
FIG. 4 is a top view of an exemplary embodiment of the present invention, in this case illustrating an exemplary connector support cover formed of a flexible material that allows for the cover to lay flat when not in use.

Additionally, depending on the chosen material, connector support cover 10 may be manufactured as a "flat", two-dimensional product, as shown in FIG. 4. The ability to manufacture cover 10 in this manner is attractive in terms of mass production capabilities and the ability to maintain lower manufacturing costs. Moreover, connector support cover 10 may be packaged in this two-dimensional form, which is easier for shipping, storage and display purposes. Stated another way, connector support cover 10 may be sufficiently flexible to lay flat when not in use.

Figure 5:
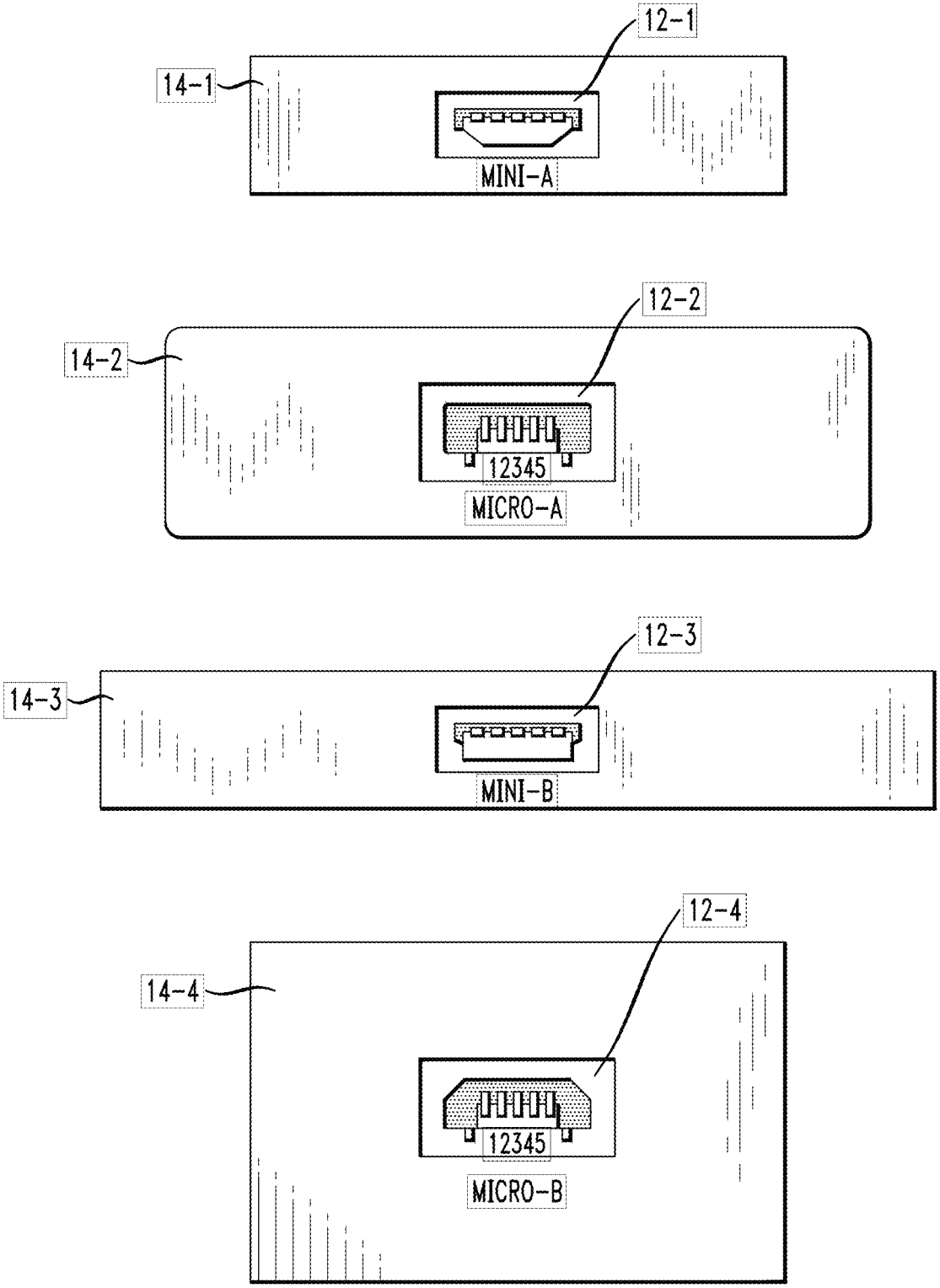
FIG. 5 contains view of several different connector geometries that may all be protected by a connector support cover formed in accordance with the present invention.

Inasmuch as each different type of power cable has a different connector size, individual covers 10 of the present invention may be formed to exhibit different-sized apertures 12. FIG. 5 contains isometric views of four different connector geometries, with end portions 14 (with apertures 12) shown in relation to each of these four geometries. Evident from the views in FIG. 5 is that fact that some connectors have a distinct "direction" in which they must be inserted (i.e., "up" or "down"). It is contemplated that a grip arm of the inventive cover may include some type of marking to allow for an individual to orient the charger in the proper direction. FIG. 1 illustrates one example, where "UP" has been marked across upper grip arm 16. Moreover, different "sizes" of cover 10 may be formed of different colors, or markings, to allow a user to properly match up the proper cover for the proper cable.

In one embodiment of the present invention, connector support cover 10 comprises a separate, individual product that is placed over, or removed from, a connector cable when attaching (removing) the cable from an associated electronic device. In other embodiments, connector support cover 10 may be formed to adhere to opposing top and bottom surfaces of a portion of a cable (thus providing an even greater surface over which the force of the removal is dissipated). Other means of joining connector support cover 10 to cable 1 may be envisioned and are considered as falling within the scope of the present invention.

It is therefore submitted that the present invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A connector support cover for protecting and controlling a connection between a charging port of an electronic device and an associated charging cable, the connector support cover comprising an upper grip arm of a predetermined length, the upper grip arm having a first upper grip arm end termination and a second upper grip arm end termination, the first upper grip arm end termination and the second upper grip arm end termination disposed as opposing end terminations along the upper grip arm;

a lower grip arm of the predetermined length, the lower grip arm having a first lower grip arm end termination and a second lower grip arm end termination, the first lower grip arm end termination and the second lower grip arm end termination disposed as opposing end terminations along the lower grip arm; and an end portion disposed between and joined between the first upper grip arm end termination and the first lower grip arm end termination so as to form a U-shaped device, the end portion including a central aperture of dimensions sufficient to allow a charging cable connector to pass through while blocking a body region of the charging cable by the remainder of the end portion.

2. The connector support cover as defined in claim 1 wherein the end portion is formed of a predetermined thickness t that is less than a length X of the charging cable connector.

3. The connector support cover as defined in claim 2 wherein t is less than one-half of X.

4. The connector support cover as defined in claim 1 wherein the upper grip arm and the lower grip arm are formed of a flexible material.

5. The connector support cover as defined in claim 4 wherein the upper and lower grip arms are formed of a material selected from the group consisting of: high-density plastic, low-density plastic heavy-weight paper, silicone, and like materials.

6. The connector support cover as defined in claim 1 wherein at least one of the upper grip arm and the lower grip arm includes a directional indicator for defining an orientation of an included conductor with respect to an associated charging port on an electronic device.

7. The connector support cover as defined in claim 1 wherein the upper grip arm, the lower grip arm, and the end portion comprise a same material.

8. The connector support cover as defined in claim 1 wherein the upper grip arm, the lower grip arm, and the end portion are formed as a unitary element.

9. The connector support cover as defined in claim 8 wherein the unitary element is sufficiently flexible to be disposed in two-dimensional form when not in use.

* * * * *